United States Patent [19]

Felix

[11] 4,406,650

[45] Sep. 27, 1983

[54] APPARATUS FOR FORMING INDIVIDUAL STACKS FROM AN ENDLESS WEB

[75] Inventor: Willi Felix, Strengelbach, Switzerland

[73] Assignee: Jos. Hunkeler AG Fabrik für Graphische Maschinen, Wikon, Switzerland

[21] Appl. No.: 246,917

[22] Filed: Mar. 23, 1981

[30] Foreign Application Priority Data

Apr. 10, 1980 [DE] Fed. Rep. of Germany ..... 3013865

[51] Int. Cl.[3] ..... B65H 45/00; B65H 45/20

[52] U.S. Cl. ..... 493/410; 493/412; 493/433

[58] Field of Search ..... 493/410–412, 493/433, 409, 413–415, 448, 451, 430; 270/39; 414/45; 221/251

[56] References Cited

U.S. PATENT DOCUMENTS

| | | | |
|---|---|---|---|
| 2,675,747 | 4/1954 | Greiner | 493/433 X |
| 2,770,392 | 11/1956 | Roberts | 221/251 X |
| 3,392,852 | 7/1968 | Tegner | 414/45 |
| 3,883,131 | 5/1975 | Andersen | 493/433 |
| 4,070,014 | 1/1978 | Takahashi | 270/39 |
| 4,205,836 | 6/1980 | Nystrand | 493/430 X |

FOREIGN PATENT DOCUMENTS

| | | | |
|---|---|---|---|
| 1327975 | 4/1963 | France | 493/411 |

*Primary Examiner*—A. J. Heinz
*Attorney, Agent, or Firm*—Werner W. Kleeman

[57] ABSTRACT

A support or carrier web, composed of sections interconnected along a separation or fracture line, is folded in a zig-zag configuration and stacked upon an elevationally displaceable support element. After the stack reaches a certain height pressure fingers are pivoted into an effectual position where they press against one side of the finished-form stack. Above these pressure fingers there are arranged suction heads which can be advanced into a position where they engage below the further arriving sections. By applying negative pressure, effective at a suction opening, there is fixidly retained at least the lowermost section of the next stack to be formed. Both of the sections belonging to the different stacks are held in an open position by the suction heads. Into the opening between both of the aforementioned sections there is introduced a roll grate carrying at its leading end a cutter or knife. This cutter disconnects both of the mentioned sections at their common connection location, and the support element now is lowered into a lower terminal position where it transfers the finished-formed stack to conveyor bands. The suction heads are again retracted so that the formed partial stack can be deposited upon the roll grate. The forming partial stack is supported for such length of time upon such roll grate until the support element, when ready to assume its stack support function, again arrives at its upper end position where it takes-over the partial stack previously reposing upon the roll grate. Due to the temporary deposition of the partial stack upon the roll grate it is not necessary to interrupt the continuous infeed of the web during the separation and outfeed of the finished stack.

27 Claims, 7 Drawing Figures

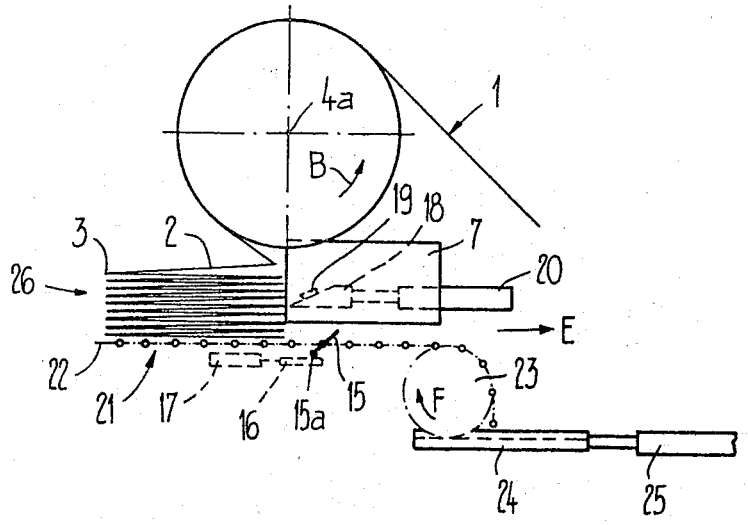
Fig. 5
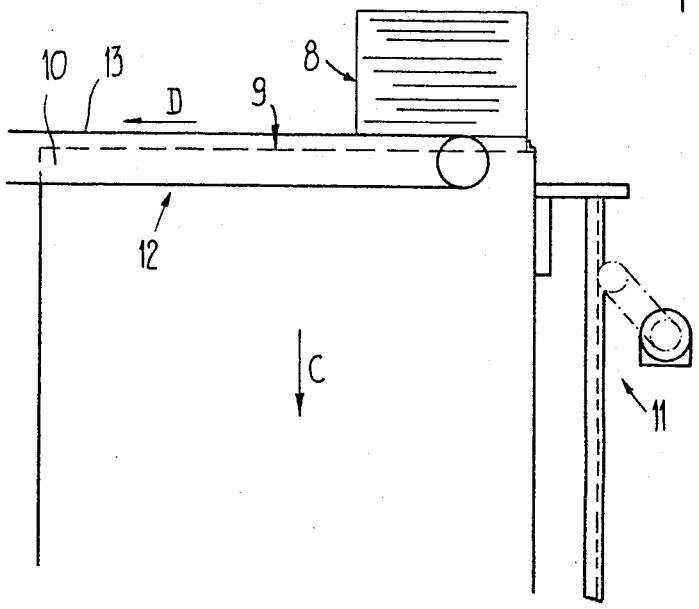

APPARATUS FOR FORMING INDIVIDUAL STACKS FROM AN ENDLESS WEB

BACKGROUND OF THE INVENTION

The present invention relates to a new and improved method of, and apparatus for, forming individual stacks from an endless web composed of web sections or portions which are interconnected with one another.

Generally speaking, the stacking method and apparatus of the present development is of the type wherein the stacks are formed from the interconnected web sections or portions of a web, the web being folded in a zig-zag configuration at the connection locations between the web portions and the thus folded stack is deposited upon a support element.

There are already known to the art numerous constructions of stacking devices, such as exemplified by way of example in German Patent Publication Nos. 2,218,535, 1,611,776, 1,145,637, 1,116,239, 1,018,432, 2,533,434, 2,219,683, German Patent Nos. 931,230 and 921,154, German Petty Pat. No. 1,911,032 and Austrian Pat. Nos. 340,959 and 330,561.

In particular, in Swiss Pat. No. 545,698 and the corresponding U.S. Pat. No. 3,871,639 there is disclosed an apparatus wherein a duplicating set or carbon set, in other words a multicopy writing surface assembly, is adhesively bonded at each second web portion or section of a cyclically advanced carrier or support web. Thereafter, the support web is folded in a zig-zag configuration and deposited upon a deposit or support table and the carbon sets or the like come to bear upon one another. If after reaching a certain stack height it is desired to remove the stack from the support or deposit table, then it is necessary to accomplish a separation or cutting operation between the uppermost support web section of the finished stack and the next following support web section or portion. Since, as already mentioned, the support web is cyclically moved it is possible to manually carry out such cutting or separation operation, but as a result the output or production capacity of the equipment is limited.

SUMMARY OF THE INVENTION

Therefore, with the foregoing in mind it is a primary object of the present invention to provide a new and improved method and apparatus for forming individual stacks from an endless web in a manner not associated with the aforementioned drawbacks and limitations of the prior art discussed immediately above.

Another and more specific object of the present invention aims at providing a new and improved method and apparatus for forming individual stacks from an endless web wherein it is possible, at high operating or working speeds of the equipment, to automatically form individual stacks.

Another and more specific object of the present invention aims at the provision of an apparatus for forming individual stacks from an endless web in an extremely reliable, accurate and efficient fashion, wherein such apparatus is relatively simple in construction and design, economical to manufacture, not readily subject to breakdown or malfunction, and requires a minimum of maintenance and servicing.

Now in order to implement these and still further objects of the invention, which will become more readily apparent as the description proceeds, the method for forming individual stacks, as contemplated by the invention, is manifested by the features that periodically after forming a stack composed of a given number of mutually interconnected, superimposed sections of the continuously infed stack, the uppermost web section or portion of the stack lying upon the support element is automatically separated from the next following web section. The arriving web sections which are intended to form the next successive stack are temporarily deposited in a stack-shaped configuration upon a support device during the removal of the previously finished formed stack from the support element. After the support element is again ready to support a stack the temporarily supported stack of stacked web sections at the support device is then transferred to the support element.

As already alluded to above, the invention is not only concerned with the aforementioned method aspects, but also involves apparatus for the performance thereof. The stacking apparatus of the invention comprises a cutter or separator device for the periodic disconnection of the uppermost web section of the stack reposing upon the support element from the next following web section whenever there has been accomplished the formation of a stack composed of a predetermined number of mutually interconnected, superimposed or mutually bearing web sections of the continuously infed web. Additionally, there is provided a support device which, during the removal of the previously finished-formed stack from the support element can be placed into a position where it engages below the arriving web section intended to form the next following stack. After the support element has assumed a position where it is ready to support a new stack it takes over the partial stack which has been temporarily formed at the support device.

Since during the separation of the web portions or sections which belong to different stacks the newly infed web section is temporarily stacked upon a support device, it is possible to remove the already finished-formed stack from the support element without having to interrupt the continuous infeed of further web sections which are to be stacked. Consequently, the stack forming operation can be accomplished at high speeds.

Preferably, the support device comprises a support element which can be introduced between the web sections which are to be disconnected from one another. At this support element there is mounted a cutter or knife element. The support element therefore serves both for supporting the intermediate stack as well as for cutting the web sections or portions.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 1 is a side view of a stack forming apparatus according to the invention;

FIGS. 3, 4 and 5 are illustrations corresponding to the showing of FIG. 1 and showing the stacking apparatus in different working or operating phases; and FIGS. 6 and 7 illustrate a different construction of the upper holding or retaining arrangement during different operating phases.

DETAILED DESCRIPTION OF THE PREFERRED EMBODIMENTS

Figures 1, 6:
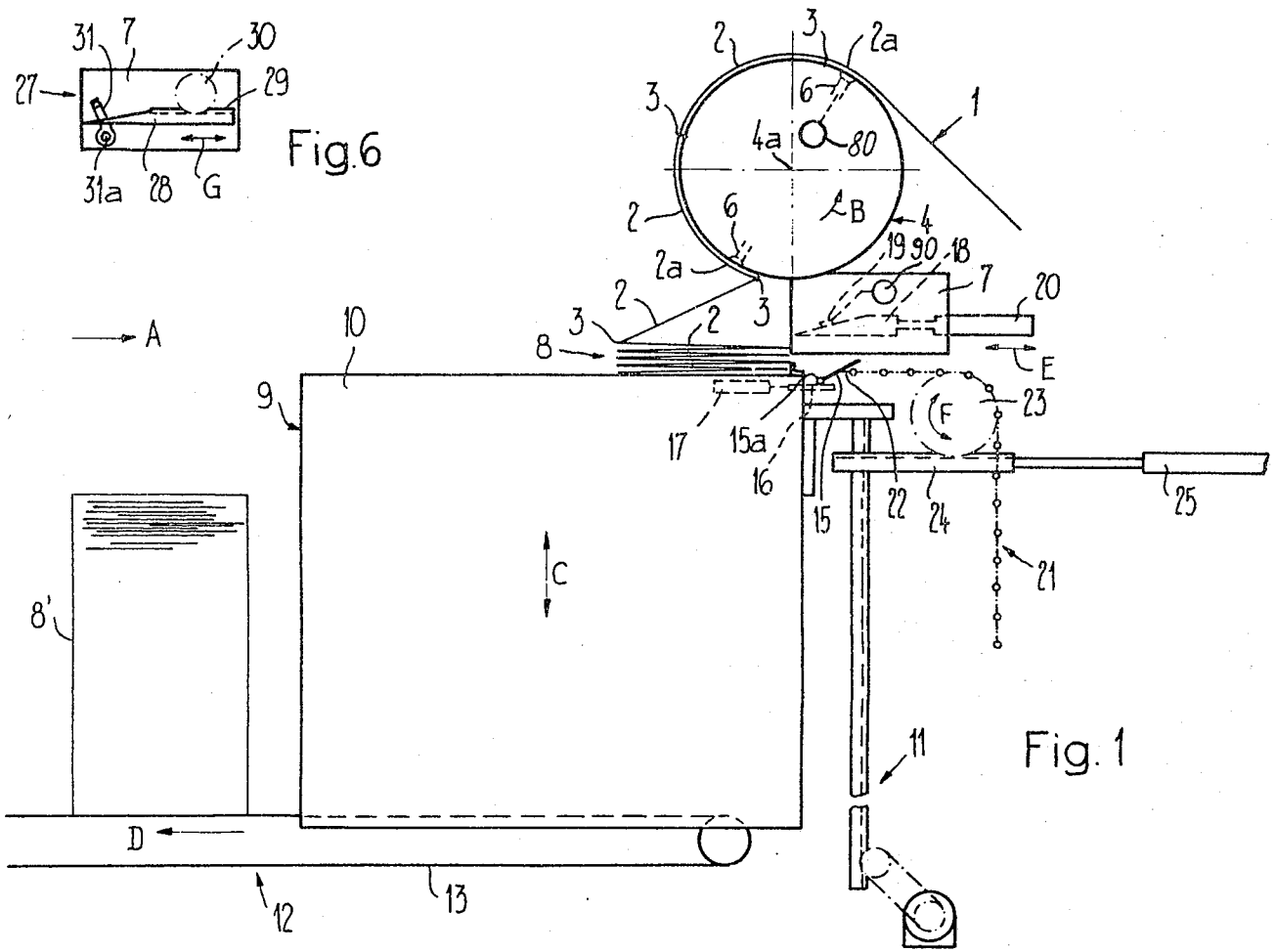

Describing now the drawings, reference character 1 designates an endless web which is formed by individual, similar web portions or sections 2. These web portions or sections 2—sometimes simply referred to as sections or portions—are interconnected with one another along fracture or weakening lines 3, for instance perforation lines, extending transversely with respect to the direction of movement of the web 1. The web 1 can be constituted, by way of example and not limitation, by an endless form (single or multiple forms), such as used in particular with data processing machines. The web 1 also can be, however, constituted as a support or carrier web at which there are applied attachments, for instance duplicating or carbon sets or the like, as the same has been disclosed in the previously mentioned Swiss Pat. No. 545,698 and the cognate U.S. Pat. No. 3,871,639 as well as in Swiss Pat. Nos. 492,566 and 524,474 and the respective cognate British Pat. Nos. 1,303,037 and 1,327,648.

The web 1 is guided over a drum or drum member 4 which is rotatably driven by any suitable drive so as to rotate in the direction of the arrow B about its drum axis 4*a*. As particularly well seen by referring to FIG. 2, the drum member 4 is provided with a plurality of discs or plates 5 or equivalent structure arranged at a mutual spacing from one another. The web 1 comes to bear upon such support discs 5. Each disc 5 is provided with two suction openings 6 or the like which can be periodically connected with any suitable source of negative pressure, as generally schematically shown in FIG. 1 by reference character 80. Both of the suction openings 6 of each disc or disc member 5 are located in the circumferential direction of such disc 5 in spaced relation from one another through a certain amount which essentially corresponds to twice the length of the web sections 2, i.e. twice the spacing between two fracture or weakening lines 3. As shown in FIG. 1, each second web section or portion 2 which travels onto the drum member 4 is fixedly retained at the drum member 4 at the web region 2*a* of its forward edge by the negative pressure or suction acting by means of the suction openings 6 and each such web section is entrained during the rotation of the drum member 4. The suction openings 6 are operatively connected for such length of time with the negative pressure source 80 until the fixedly retained web region 2*a* is located at the underside of the drum member 4, as illustrated in FIG. 1. At that time the suction openings 6 are disconnected from the negative pressure source 80, resulting in release of the seized web regions 2*a*. Between the individual discs 5 there are arranged stop or impact members 7 (FIG. 2) at which impacts the entrained web section 2. In this manner it is possible to fold in a zig-zag configuration the web 1 at the weakening or fracture lines 3 and to deposit such in the form of a stack 8 which bears upon a support element or support means 9.

Figure 2:
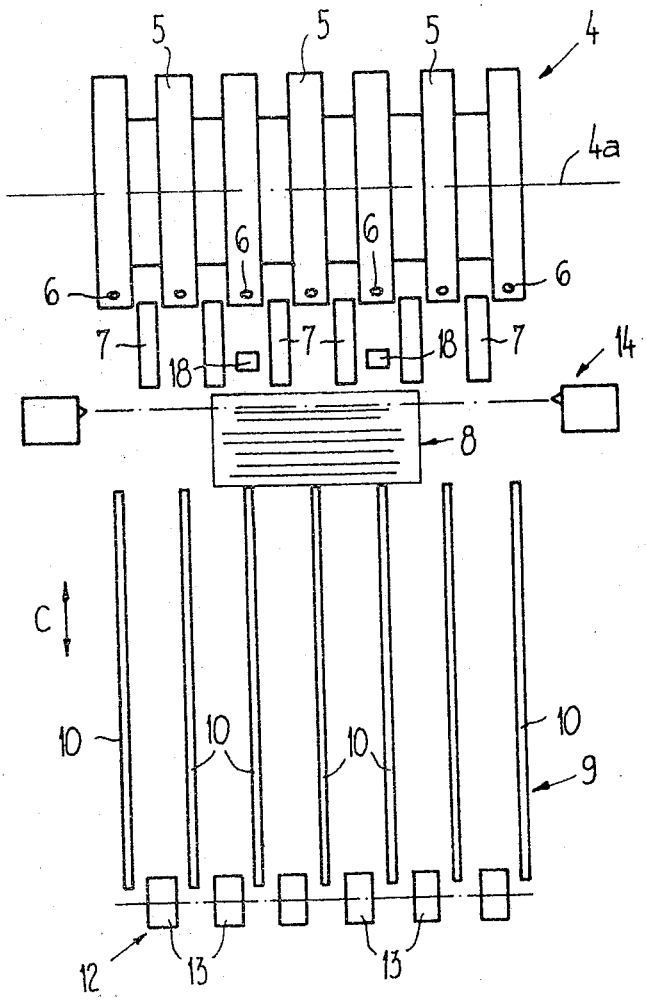
FIG. 2 illustrates the apparatus of FIG. 1 viewed in the direction of the arrow A.

The support element 9 can be constituted by a plurality of upright plates or plate members 10 arranged at a mutual spacing from one another, as best seen by referring to FIG. 2. Operatively connected with the support element 9 is a suitable drive arrangement 11, here shown as a gear rack drive by way of example, by means of which the support element 9 can be raised and lowered in the direction of the double-headed arrow C. In order to outfeed the stack 8, which is formed upon the support element 9 in a manner which will be described more fully hereinafter, there is provided a stationary outfeed conveyor 12 or equivalent outfeed device which, in the embodiment under discussion, comprises for instance a number of conveyor belts or bands 13. Each one of the conveyor belts 13 is arranged between two neighboring plates or plate members 10 of the support element 9. The conveyor belts or bands 13 are driven in the direction of the arrow D.

As it will be seen by reverting to FIG. 2, there is also provided a stack sensing device, here shown in the form of a light barrier or photoelectric cell arrangement 14 which, whenever a certain stack height is reached, triggers lowering of the support element 9, as also will be explained more fully hereinafter.

Additionally, there are provided two pressure or contact fingers 15 or equivalent structure, wherein in FIG. 1 only one of such pressure fingers has been shown. These pressure fingers 15 are distributively arranged in spaced relationship from one another over the width of the web 1. Both of the pressure fingers 15 are attached to a pivot shaft 15*a* which can be appropriately pivoted or rotated by means of a suitable drive 16, here shown as a gear rack. This gear rack 16 is connected with a suitable drive device, for instance a pneumatic cylinder arrangement 17. The pressure fingers 15 are pivotable out of the ineffectual or inoperative position shown in FIG. 1 into an effectual or operative position where they press upon the finished-formed stack 8 in a manner still to be explained. Both of these pressure fingers 15 form a lower retaining or holder arrangement for the retention of at least the uppermost web section or portion of the finished-formed stack 8.

For holding the lowermost web section of the next following stack which is to be formed there is provided an upper holding or retention arrangement which contains two juxtapositioned suction heads 18 arranged at a mutual spacing from one another. The suction heads 18 are dispositioned above the pressure fingers 15. Each suction head 18 contains a suction opening or port 19 which can be periodically connected with a schematically illustrated suitable negative pressure source 90 (FIG. 1). Both of the suctions heads 18 can be moved to-and-fro in the direction of the arrow E by means of a pneumatic cylinder 20 or equivalent drive.

The support device in the form of a roll grate arrangement or roll grate 21 and serving as the support element for the temporary stacking of the incoming web sections 2 carries at its front end a cutter or knife 22. The roll grate 21 is guided over a roller 23 which can be rotatably driven so as to revolve in the direction of the arrow F. For this purpose a drive in the form of a gear rack 24 coacts with the roller 23, the rack 24 being reciprocated to-and-fro by means of a pneumatic cylinder unit 25 or equivalent drive.

Figures 4, 7:
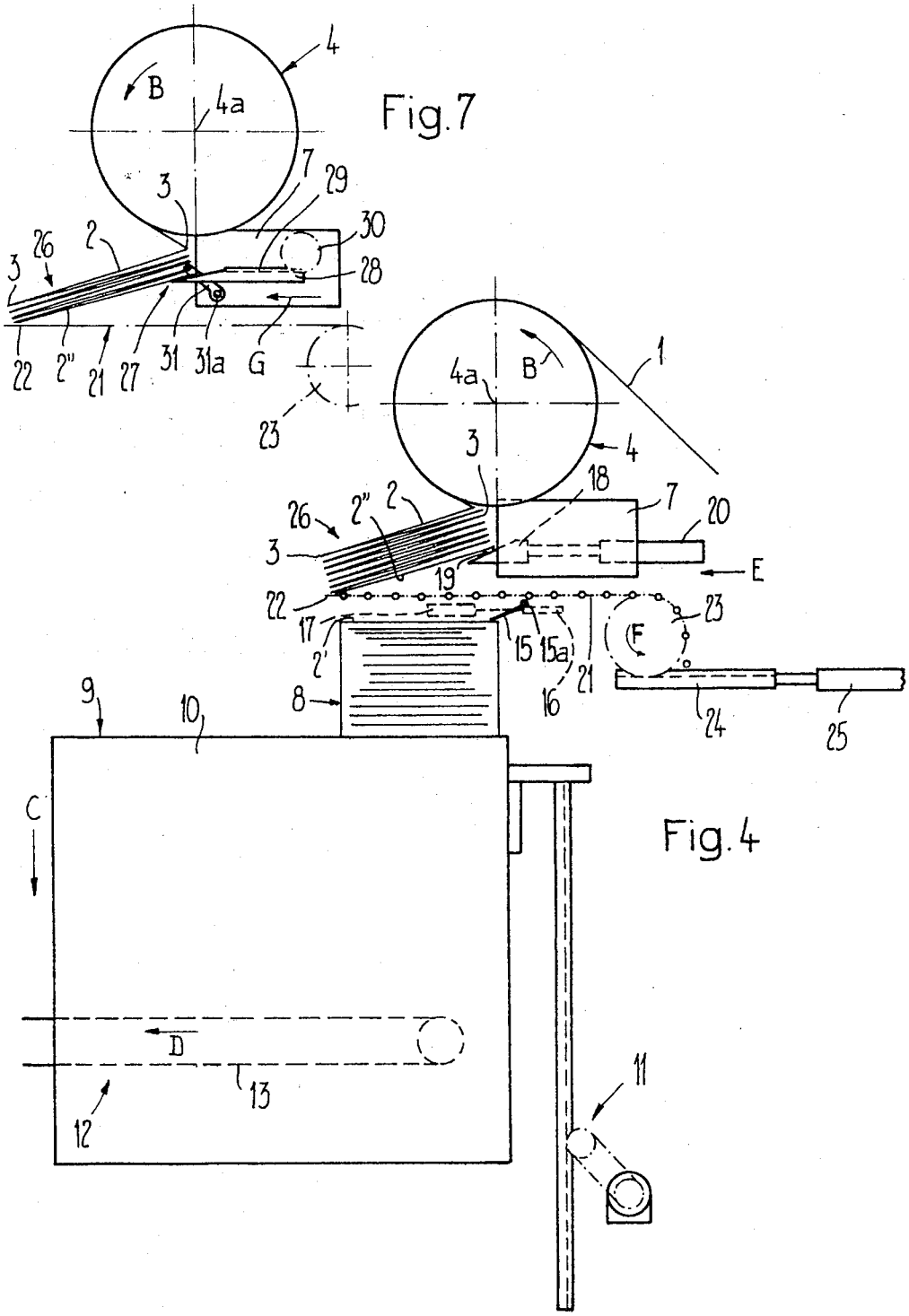

FIGS. 6 and 7 portray a different design of the upper holding or retention arrangement. Here, instead of using both of the suction heads 18 there is provided a respective clamp or clamping means 27. This clamp 27 will be seen to comprise a lower clamp portion 28 which can be moved to-and-fro in the direction of the arrow G. The lower clamp portion or part 28 is provided with a toothed arrangement or teeth means 29 which mesh with a driven gear 30. Moreover, the clamp 27 possesses an upper movable clamp portion or part 31 which can be pivoted about a shaft or axis 31*a* for the purpose of opening and closing the clamp or clamp means 27.

Having now had the benefit of the description of possible exemplary constructions of apparatus for forming individual stacks from an endless web, the mode of operation thereof will now be described initially based upon FIGS. 1 to 5.

As already mentioned, the web 1 travels over the drum member 4 where there is retained the leading region of each second web section 2 by the application of the negative pressure during the rotation of the drum member 4. In this way the web 1 is deposited in a zigzag formation upon the support element 9, and web folding is accomplished at the weakening or fracture lines 3 and the web sections 2 come to lie on top of one another, as best seen by referring to FIG. 1. Now if the stack 8 which has formed upon the support element 9 has reached a predetermined height, then the light barrier 14 responds and through the action of the rack drive 11 causes lowering of the support element 9 by a certain amount or distance. Due to this stepwise lowering of the support element 9, with increasing stack height, there is attained the result that the spacing between the upper edge of the stack 8 and the drum member 4 remains approximately constant. The web sections 2 are counted at a suitable location of the equipment by a not particularly shown but standard counter which can be pre-set by a counter pre-selector. Once the predetermined set counter number or state has been reached then the pneumatic cylinder arrangement or unit 20 is activated, so that both of the suction heads 18 can be introduced between the web sections 2' and 2'' in the direction of the arrow E. The suction heads 18 thus engage below the lowermost web section 2'' of the next stack 26 which is to be formed. At the same time suction heads 18 are connected with the negative pressure source 90, so that the aforementioned lowermost section 2'' is fixedly retained.

Figure 3:
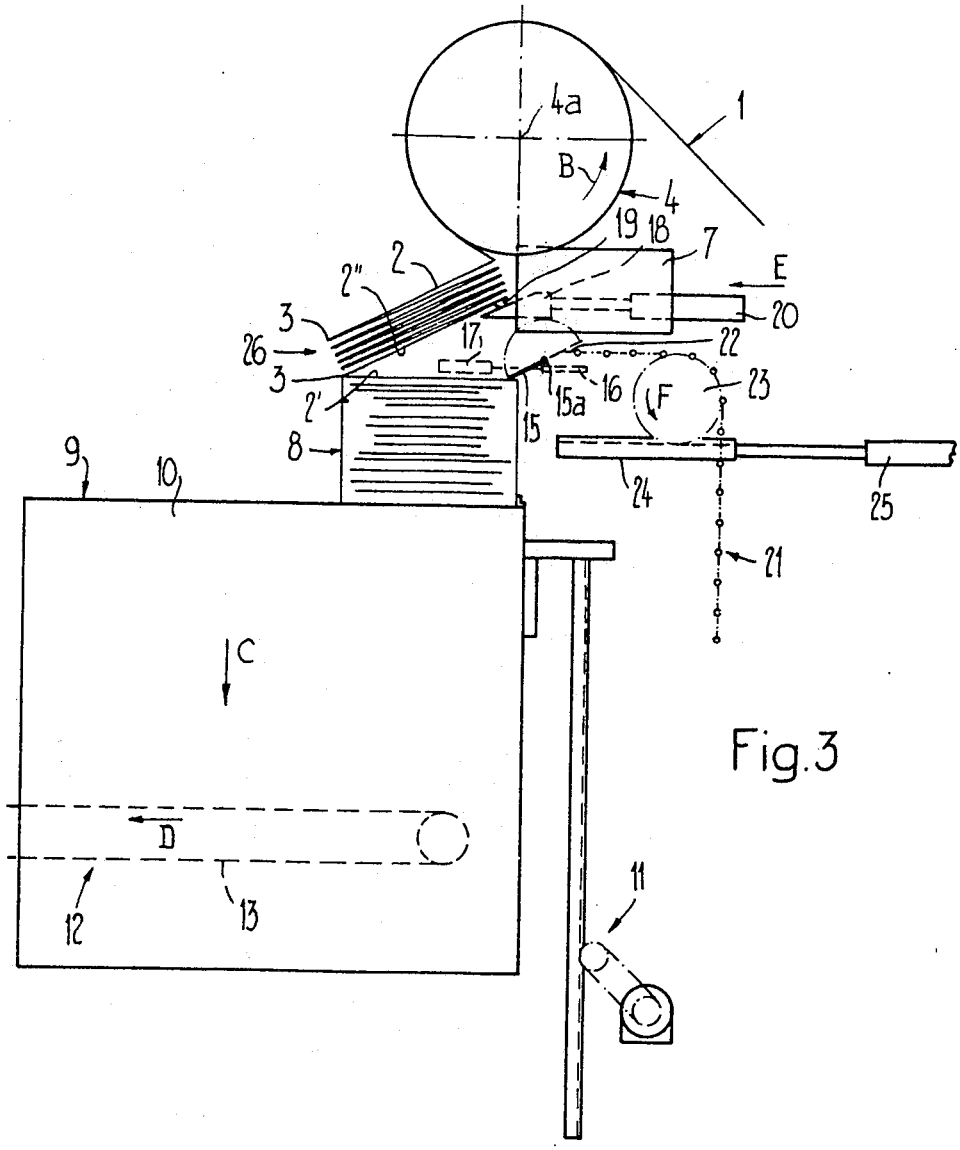

The support element 9 now is lowered to such an extent that by actuating the pneumatic cylinder unit 17 and through appropriately advancing or forwardly feeding rack 16 the pressure or contact fingers 15 can be pivoted about their pivot shaft or axis 15*a* out of the ineffectual position, in counterclockwise direction, into their effectual or operative position where they press upon the finished-formed stack 8 (FIG. 3). During this working phase, as shown in such FIG. 3, sufficient space is free between the uppermost section 2'' of the finished-formed stack 8 and the lowermost section 2'' of the next following stack 26 in order to introduce the cutter or knife means 22 or equivalent separation device. The partial stack 26 which forms because of the continuous infeed of the web 2, reposes at one edge upon both of the suction heads or head members 18 and is still connected at its lowermost web section 2'' with the uppermost web section 2' of the finished-formed stack 8.

By actuating the pneumatic cylinder unit 25 the gear rack 24 is now forwardly advanced, so that the roller or drum member 23 is rotated in the direction of the arrow F, i.e. in the counterclockwise direction, as shown in FIG. 4. Consequently, the roll grate arrangement or roll grate 21 is forwardly advanced and introduced between both of the web sections 2' and 2''. The cutter 22 now disconnects both of the sections 2' and 2'' at their connection location 3, i.e. at their weakened or fracture portion. The partial stack 26 which is in the process of being newly formed still bears upon the suction heads 18, but on the other hand is supported at the other side of the stack upon the roll grate arrangement 21.

As best seen by referring to FIG. 5, the support element 9 is now lowered in the direction of the arrow C by means of the rack drive 11 until the support element 9 has reached its lowermost terminal or end position. In this lowermost terminal position the finished-formed stack 8 is supported upon the conveyor belts or bands 13 and is then outfed in the direction of the arrow D by such conveyor bands 13, as has been generally indicated in FIG. 1 by the stack designated by reference character 8'. Additionally, the suction heads 18 are returned back in the direction of the arrow E into a position where they are no longer in coacting relationship with the partial stack 26. This partial stack 26 therefore then completely comes to bear at the roller or roll grate 21. By actuating the pneumatic cylinder unit 17 the pressure fingers 15 are again pivoted back into their ineffectual position.

When the conveyor belts or bands 13 have outfed the finished-formed stack 8 from the support element 9, then the element 9 which is ready for receiving the next stack is moved again into its upper terminal position by the rack drive 11. Once the support element 9 has reached this upper terminal or end position then the rack 24 is forwardly advanced by the action of the pneumatic cylinder unit 25, with the result that the roll 23 is rotated in the clockwise direction, and the roll grate 21 is retracted. The partial stack 26 formed upon such roll grate 21 now is taken-over by the support element 9. For the forming, separation and outfeed of a new stack the previously described operations are repeated.

Since during the cutting or separation operation and the outfeed of the finished-formed stack 8 the newly formed partial stack 26 is temporarily supported upon the roll grate or roll grate arrangement 21, it is possible to form individual stacks 8 without having to interrupt the continuous infeed of the web 1. If there are used instead of the suction heads 18 the clamping elements or clamps 27 of the arrangement of FIGS. 6 and 7, then the previously described mode of operation remains essentially the same. By rotating the gear 30 the lower clamp portion 28 is advanced into a position where, just as was the case for the suction heads 18, it engages below the lowermost web section 2'' of the next partial stack 26 which is to be formed. By pivoting the upper movable clamp portion 31 about its pivot shaft or axis 31*a* there is at least fixedly clamped the aforementioned lowermost section 2'' and possibly still further web sections 2 between both of the clamp portions or parts 28, 31, as the same has been particularly shown in FIG. 7. In contrast to the embodiment of FIGS. 1 to 5, with the variant embodiment of FIGS. 6 and 7 the sections of the partial stack 26 are not fixedly retained by the action of a negative pressure or vacuum, rather by a clamping force.

Based upon the showing of the drawings there have been previously been disclosed two preferred embodiments of the inventive apparatus. However, it should be understood that the described equipment can be structured differently in a number of aspects than heretofore described and illustrated. By way of example there will be disclosed hereinafter a few possible variant constructions.

The drive of the different parts can be accomplished mechanically, pneumatically or also hydraulically. Instead of using a roll grate arrangement 21 it is also possible to employ a different design of receiver or support element for the temporary support of the partial stack 26 which is being formed, for instance a plate. However, in contrast to such plate the roll grate arrangement 21 has the advantage that it can be turned or deflected and accordingly requires a lesser amount of space in its movement direction.

Although the mounting of the cutter 22 has been shown and described as at the leading end of the roll grate 21 and constitutes a particularly simple solution, it is also conceivable for the cutter or separation element not to be attached at the receiver or support element, which then however would require a special drive for such cutter or separation element 22. Additionally, it is also possible to employ, instead of the pressure fingers 15, other means for applying a pressure or contact force to the finished-formed stack 8, so that during the separation operation there can be fixedly retained at least the uppermost web section of the finished stack 8.

It should be understood that the zig-zag folding of the web 1 also can be accomplished in a different manner than herein described, for instance as disclosed in the previously mentioned Swiss Pat. No. 545,698 and the cognate U.S. Pat. No. 3,871,639.

The disclosed stacking equipment can be arranged forwardly of the most different types of suitable coacting machinery or machines. However, the stacking equipment of the invention is particularly suitable for cooperating with a device for the automatic application of attachments to an endless web, as the same have been disclosed in the German Patent Publication No. 3,022,525 and the commonly assigned U.S. application Ser. No. 68,740, filed Aug. 22, 1979, to which reference may be readily had and the disclosure which is incorporated herein by reference.

While there are shown and described present preferred embodiments of the invention, it is to be distinctly understood that the invention is not limited thereto, but may be otherwise variously embodied and practiced within the scope of the following claims. Accordingly,

What I claim is:

1. An apparatus for forming individual stacks from an endless web composed of interconnected web sections, comprising:

means for the substantially zig-zag folding of a continuously infed web at connection locations of the web sections with one another;

a support element upon which there can be supported stacks formed of the zig-zag folded web, each stack having an uppermost web section;

a separation device for the periodic separation of the uppermost web section of one of the stacks reposing upon the support element from a next following web section of the web which forms a lowermost web section of a next successive stack which is to be formed after forming the one stack reposing upon the support element and which one reposing stack is composed of a predetermined number of mutually interconnected, superimposed web sections of the web;

holder means for temporarily fixedly and individually retaining during said periodic separation each of said uppermost web section of said one reposing stack and said next following lowermost web section of said next successive stack which is to be formed and which web sections are to be separated from one another;

a support device movable into an effectual position engaging below arriving web sections intended to form said next successive stack when said one reposing stack which defines a previously finished-formed stack is being removed from the support element;

means for displacing said support device into said effectual position;

said support element, when ready to receive a new stack, taking-over a partial stack of said next successive stack which is to be formed and temporarily formed upon said support device;

said holder means comprising a first retention arrangement for the retention of at least the uppermost web section of the previously finsihed-formed stack and a second retention arrangement for holding at least the lowermost web section of the next successive stack to be formed;

both of said retention arrangements being located in spaced superimposed relationship in order to retain in a raised position from one another, during the separation operation, the web sections which are to be separated from one another; and said first retention arrangement comprising at least one movable holder element which can be brought into a position where it defines means for directly pressing upon the previously finished-formed stack.

2. The apparatus as defined in claim 1, wherein:

said holder element comprises a pressure finger pivotable about a pivot shaft.

3. The apparatus as defined in claim 1, wherein:

said support device comprises a support member which can be introduced between web sections which are to be separated from one another.

4. The apparatus as defined in claim 3, wherein:

said support member comprises grate means for temporarily supporting said next successive stack which is to be formed.

5. The apparatus as defined in claim 3, wherein:

said separation device comprises a cutter element arranged at said support member.

6. The apparatus as defined in claim 1, further including:

means for raising and lowering said support element.

7. The apparatus as defined in claim 6, wherein:

said raising and lowering means serves to displace said support element into a lower terminal position and an upper terminal position; and outfeed conveyor means cooperating with said support element when in said lower terminal position in order to take-over a stack transferred from said support element to said outfeed conveyor means.

8. The apparatus as defined in claim 7, wherein:

said outfeed conveyor means comprises at least one belt conveyor at which comes to bear the stack to be transferred at the region of the lower terminal position of the support element.

9. The apparatus as defined in claim 1, wherein:

the web which is processed comprises an endless web provided with attachments and from which there are formed the individual stacks.

10. An apparatus for forming individual stacks from an endless web composed of interconnected web sections, comprising:

means for the substantially zig-zag folding of a continuously infed web at connection locations of the web sections with one another;

a support element upon which there can be supported stacks formed of the zig-zag folded web, each stack having an uppermost web section;

a separation device for the periodic separation of the uppermost web section of one of the stacks reposing upon the support element from a next following web section of the web which forms a lowermost web section of a next successive stack which is to be formed after forming the one stack reposing upon the support element and which one reposing stack is composed of a predetermined number of mutually interconnected, superimposed web sections of the web;

holder means for temporarily fixedly and individually retaining during said periodic separation each of said uppermost web section of said one reposing stack and said next following lowermost web section of said next successive stack which is to be formed and which web sections are to be separated from one another;

a support device movable into an effectual position engaging below arriving web sections intended to form said next successive stack when said one reposing stack which defines a previously finished-formed stack is being removed from the support element;

means for displacing said support device into said effectual position;

said support element, when ready to receive a new stack, taking-over a partial stack of said next successive stack which is to be formed and temporarily formed upon said support device;

said folding means comprises a rotatably driven drum over which there is guided the web to be folded in zig-zag configuration;

means for fixedly retaining each second incoming web section at the region of a leading edge thereof during the rotation of the drum for such length of time until the retained web region is located at an underside region on the drum;

said fixedly retaining means comprises at least two selectively operative holder devices provided for said drum; and said holder devices being arranged in spaced relationship from one another at the circumference of said drum by an amount essentially corresponding to twice the length of a web section.

11. The apparatus as defined in claim 10, wherein:

each holder device comprises a suction device;

means defining a source of negative pressure; and said suction devices being periodically connectable with said negative pressure source.

12. An apparatus for forming individual stacks from an endless web composed of interconnected web sections, comprising:

means for the substantially zig-zag folding of a continuously infed web at connection locations of the web sections with one another;

a support element upon which there can be supported stacks formed of the zig-zag folded web, each stack having an uppermost web section;

a separation device for the periodic separation of the uppermost web section of one of the stacks reposing upon the support element from a next following web section of the web which forms a lowermost web section of a next successive stack which is to be formed after forming the one stack reposing upon the support element and which one reposing stack is composed of a predetermined number of mutually interconnected, superimposed web sections of the web;

holder means for temporarily fixedly and individually retaining during said periodic separation each of said uppermost web section of said one reposing stack and said next following lowermost web section of said next successive stack which is to be formed and which web sections are to be separated from one another;

a support device movable into an effectual position engaging below arriving web sections intended to form said next successive stack when said one reposing stack which defines a previously finished-formed stack is being removed from the support element;

means for displacing said support device into said effectual position;

said support element, when ready to receive a new stack, taking-over a partial stack of said next successive stack which is to be formed and temporarily formed upon said support device;

said holder means comprises a first retention arrangement for the retention of at least the uppermost web section of the previously finished-formed stack and a second retention arrangement for holding at least the lowermost web section of the next successive stak to be formed;

both of said retention arrangements being located in spaced superimposed relationship in order to retain in a raised position from one another, during the separation operation, the web sections which are to be separated from one another; and said second retention arrangement comprises at least one clamp means movable into an effectual position where it defines means for fixedly retaining at least the lowermost web section of the next successive stack which is to be formed.

13. The apparatus as defined in claim 12, wherein:

said support device comprises a support member which can be introduced between web sections which are to be separated from one another.

14. The apparatus as defined in claim 13, wherein:

said support member comprises grate means for temporarily supporting said next successive stack which is to be formed.

15. The apparatus as defined in claim 13, wherein:

said separation device comprises a cutter element arranged at said support member.

16. The apparatus as defined in claim 12, further including:

means for raising and lowering said support element.

17. The apparatus as defined in claim 16, wherein:

said raising and lowering means serves to displace said support element into a lower terminal position and an upper terminal position; and outfeed conveyor means cooperating with said support element when in said lower terminal position in order to take-over a stack transferred from said support element to said outfeed conveyor means.

18. The apparatus as defined in claim 17, wherein:

said outfeed conveyor means comprises at least one belt conveyor at which comes to bear the stack to be transferred at the region of the lower terminal position of the support element.

19. The apparatus as defined in claim 12, wherein:

the web which is processed comprises an endless web provided with attachments and from which there are formed the individual stacks.

20. An apparatus for forming individual stacks from an endless web composed of interconnected web sections, comprising:

means for the substantially zig-zag folding of a continuously infed web at connection locations of the web sections with one another;

a support element upon which there can be supported stacks formed of the zig-zag folded web, each stack having an uppermost web section;

a separation device for the periodic separation of the uppermost web section of one of the stacks reposing upon the support element from a next following web section of the web which forms a lowermost web section of a next successive stack which is to be formed after forming the one stack reposing upon the support element and which one reposing stack is composed of a predetermined number of mutually interconnected, superimposed web sections of the web;

holder means for temporarily fixedly and individually retaining during said periodic separation each of said uppermost web section of said one reposing stack and said next following lowermost web section of said next successive stack which is to be formed and which web sections are to be separated from one another;

a support device movable into an effectual position engaging below arriving web sections intended to form said next successive stack when said one reposing stack which defines a previously finished-formed stack is being removed from the support element:

means for displacing said support device into said effectual position;

said support element, when ready to receive a new stack, taking-over a partial stack of said next successive stack which is to be formed and temporarily formed upon said support device;

said holder means comprises a first retention arrangement for the retention of at least the uppermost web section of the previously finished-formed stack and a second retention arrangement for holding at least the lowermost web section of the next successive stack to be formed;

both of said retention arrangements being located in spaced superimposed relationship in order to retain in a raised position from one another, during the separation operation, the web sections which are to be separated from one another; and said second retention arrangement comprises at least one movable suction element, means for moving said suction element into a position where it engages below the lowermost web section of the next successive stack to be formed.

21. The apparatus as defined in claim 11, wherein:

said support device comprises a support member which can be introduced between web sections which are to be separated from one another.

22. The apparatus as defined in claim 21, wherein:

said support member comprises grate means for temporarily supporting said next successive stack which is to be formed.

23. The apparatus as defined in claim 21, wherein:

said separation device comprises a cutter element arranged at said support member.

24. The apparatus as defined in claim 20, further including:

means for raising and lowering said support element.

25. The apparatus as defined in claim 24, wherein:

said raising and lowering means serves to displace said support element into a lower terminal position and an upper terminal position; and outfeed conveyor means cooperating with said support element when in said lower terminal position in order to take-over a stack transferred from said support element to said outfeed conveyor means.

26. The apparatus as defined in claim 25, wherein:

said outfeed conveyor means comprises at least one belt conveyor at which comes to bear the stack to be transferred at the region of the lower terminal position of the support element.

27. The apparatus as defined in claim 20, wherein:

the web which is processed comprises an endless web provided with attachments and from which there are formed the individual stacks.

* * * * *